US010422130B2

(12) United States Patent
Parra Saavedra

(10) Patent No.: US 10,422,130 B2
(45) Date of Patent: Sep. 24, 2019

(54) STRUCTURAL SYSTEM OF STEEL PLATES AND WALLS WITH BIOCLIMATIC AND ACOUSTIC APPLICATION

(71) Applicant: Edgar Hernan Parra Saavedra, Bogota (CO)

(72) Inventor: Edgar Hernan Parra Saavedra, Bogota (CO)

( * ) Notice: Subject to any disclaimer, the term of this patent is extended or adjusted under 35 U.S.C. 154(b) by 0 days.

(21) Appl. No.: 15/574,091

(22) PCT Filed: Jul. 9, 2016

(86) PCT No.: PCT/IB2016/054128
§ 371 (c)(1),
(2) Date: Nov. 14, 2017

(87) PCT Pub. No.: WO2016/181375
PCT Pub. Date: Nov. 17, 2016

(65) Prior Publication Data

US 2018/0148929 A1 May 31, 2018

(30) Foreign Application Priority Data

May 14, 2015 (CO) ..... 15-111107

(51) Int. Cl.

| | |
|---|---|
| ***E04B 1/62*** | (2006.01) |
| ***E04C 1/39*** | (2006.01) |
| ***E04B 1/88*** | (2006.01) |
| ***E04B 2/72*** | (2006.01) |
| ***E04B 1/74*** | (2006.01) |
| *E04B 1/24* | (2006.01) |

(52) U.S. Cl.
CPC ..... *E04C 1/392* (2013.01); *E04B 1/74* (2013.01); *E04B 1/88* (2013.01); *E04B 2/72* (2013.01); *E04B 1/24* (2013.01); *E04B 2001/249* (2013.01); *E04B 2001/2451* (2013.01); *E04B 2001/2481* (2013.01); *E04B 2103/06* (2013.01)

(58) Field of Classification Search
CPC .... E04C 1/392; E04C 1/42; E04B 1/88; F24J 2/0444; F24J 2002/5216; H02S 20/26
See application file for complete search history.

(56) References Cited

U.S. PATENT DOCUMENTS 3,501,878 A * 3/1970 Segal ..... E04B 1/62 181/290
4,120,285 A * 10/1978 Nugent ..... F24J 2/055 126/653
4,274,396 A * 6/1981 Peters ..... F24J 2/0444 126/663

(Continued)

*Primary Examiner* — Gisele D Ford
(74) *Attorney, Agent, or Firm* — Hoglund & Pamias, PSC; Roberto J. Rios

(57) ABSTRACT

The structural system of steel walls and plates with bioclimatic and sound application relates to the creation of a general structure of buildings, walls, roofs and soils with thermal and sound isolation from an earthquake-resistant steel structure of hollow beams and columns complemented with walls and plates in oval piping made of steel, which may be installed both vertically and horizontally with their own fixation means in a building for air recirculation, with interconnected and addressed tubular structures which contain thermal and sound isolation materials controlling airflow in the to modify the weather and/or sound conditions inside the building.

10 Claims, 6 Drawing Sheets

(56) References Cited

U.S. PATENT DOCUMENTS

| | | | | | |
|---|---|---|---|---|---|
| 4,338,917 | A * | 7/1982 | Keller | F24J 2/00 | 126/630 |
| 4,901,676 | A * | 2/1990 | Nelson | B32B 3/02 | 122/19.2 |
| 5,092,101 | A * | 3/1992 | Kunert | B32B 17/06 | 156/100 |
| 5,347,779 | A * | 9/1994 | Jordan | F24F 5/0075 | 52/302.3 |
| 8,215,082 | B2 * | 7/2012 | Stein | E04D 13/0481 | 52/11 |
| 9,816,728 | B2 * | 11/2017 | Peng | F24J 2/0433 | |
| 9,863,142 | B2 * | 1/2018 | Stein | E04B 2/58 | |
| 2012/0102844 | A1 * | 5/2012 | Damo | F24J 2/0444 | 52/1 |
| 2012/0186579 | A1 * | 7/2012 | Dopp | F24J 2/145 | 126/684 |
| 2013/0212957 | A1 * | 8/2013 | Cempulik | E06B 3/66319 | 52/172 |
| 2014/0026499 | A1 * | 1/2014 | Bagatelos | E04B 2/90 | 52/173.3 |
| 2015/0059828 | A1 * | 3/2015 | Asci | H02S 20/26 | 136/246 |
| 2015/0125634 | A1 * | 5/2015 | Jefferson | C03B 17/06 | 428/34 |
| 2016/0138831 | A1 * | 5/2016 | Peng | F24J 2/0433 | 126/652 |
| 2017/0227255 | A1 * | 8/2017 | Rieder | F24J 2/0444 | |

* cited by examiner

STRUCTURAL SYSTEM OF STEEL PLATES AND WALLS WITH BIOCLIMATIC AND ACOUSTIC APPLICATION

TECHNOLOGICAL SECTOR

The structural system of steel walls and plates with bioclimatic and sound application relates to the creation of a general structure of buildings, walls, roofs and soils with thermal and sound isolation from an earthquake-resistant steel structure of hollow beams and columns complemented with walls and plates in oval piping made of steel, which may be installed both vertically and horizontally with their own fixation means in a building for air recirculation, with tubular interconnected and addressed structures which contain thermal and sound isolation materials controlling airflow in the to modify the weather and/or sound conditions inside the building.

STATE-OF-THE-ART

Solutions of buildings for thermal and sound control with walls involving thermal or sound dissipaters have been proposed such as patent WO2009120092 "STRUCTURAL WALL", patent "Sound and heat insulating panels" with publication number U.S. Pat. No. 3,501,878 A or patent "Foam panel with melted surface" with publication EP 1621696. These applications present solutions specifically of walls as a monolytic structure without possibility of directed flows circulation, but they are solutions of structural walls with isolating components; unlike the new application which is not a monolytic wall but a wall with hollow piping with airflow addressing to control temperature with isolations in the junction of each inner tube attached to the receiver beams or columns.

On the other hand, there are methods of buildings manufacturing through galvanized steel piping, such as U.S. Pat. No. 5,282,343, which uses connectors articulating a system which as a whole is responsible for the earthquake-resistance of building, this is, the connectors, tubes in walls and tubes in plates have earthquake-resistance characteristics. Such building system is presented limited to buildings up to 3 floors; additionally system generates walls and plates of 203 millimeters width which decreases the residential area of buildings, while the bioclimatic and sound structural system of the new invention proposes a main beam-column structure as an earthquake-resistant solution which does not restraint the building in only three floors. The hollow piping of the new invention conform non-load bearing walls and plates on which pipes are eventually used as beams, according to the earthquake-resistance codes. Additionally, when using an oval tube of 60 millimeters increases the residential area of the new building.

Another novel characteristic in the structural bioclimatic and sound system consists of the use of walls and plates as elements that additionally allow the application of passive systems of conditioning and/or sound comfort which are not proposed in any other solutions proposed. The same elements are used as containers for other materials for thermal and/or sound control; the thermal conductivity of steel piping surface shall be controlled through the decrease of conductivity areas with longitudinal slots on the surfaces of contact between the tubes and/or through the sheet coating, without affecting its functions as a wall or plate in the building.

Currently, there are other patent with international publication number WO 2009/151307 A1 entitled "Heat dissipating system for buildings with concrete block and vault", which according to its name use hollow breaks or concrete walls and plates creating conducts which allow refrigerating the wall and decreasing the heat inside the building, this method of traditional construction requires qualified personnel to install it and its construction time is higher, while the structural bioclimatic and sound system has a much more rapid method of construction than the traditional one and it does not require expertise personnel for its construction; on the other hand, in the existent patent, ducts created in the walls are vertical and they are generated by different elements, which does not allow ensuring an easy conduct airtightness and integrity unlike the structural bioclimatic and sound system which have ducts inducing airflows both horizontal and vertical across the walls, and the tubes may be easily used as containers of other materials which allow improving the thermal and/or sound control. The traditional construction is too heavy due to the materials used, besides that material to be reused by the end of the project's shelf-life is only 20% while thanks to the material of the structural bioclimatic and sound system its weight is lighter than the traditional construction and it may be reused in 95% decreasing the carbon footprint of the building by the end of the project, and not less important, the ducts made with the traditional construction, which are made from elements that are attached with mortar, have no guaranty of airtightness or integrity++ while the structural bioclimatic and sound system allow ducts supporting bending loads suffered throughout its shelf-life thanks to the steel of the new application which perfectly supports bending loads.

The invention solves the technical problem of heat and sound problem in buildings creating plates and walls for buildings with its own air recirculation mechanism with tubular interconnected and directed tubular structures containing thermal and sound isolating materials controlling airflows in them to modify the heat and/or sound conditions inside the building. The structural traditional systems depend in a high percentage on conditioning active systems which cause higher costs of installation, operation and maintenance, which historically have made unfeasible the generation of climatic conditions appropriate for a high percentage of people.

The technical problem of temperature and sound inside a building is overpassed with the same structural composition, without external accessories for temperature control or added isolation since the structure walls and plates may be used as containers for other materials to modify the thermal and sound properties and inner airflow may be induced and controlled eliminating this way the technical problem of considering which walls and plates are exclusively for structural support and that for a conditioning or sound comfort added or external mechanisms are required.

The invention is an original solution combining also Light and heat management with transparency and dark painting absorbing Light, surprising also with the execution of the effect known as greenhouse effect to modify the climatic conditions inside the building, in construction condition much more rapid and without needing additional works or equipment, allowing the access to these comfort levels to many people.

DESCRIPTION OF INVENTION

The STRUCTURAL SYSTEM OF STEEL WALLS AND PLATES WITH BIOCLIMATIC AND SOUND APPLICATION is an invention composed of walls and plates in buildings which from an oval piping obtained from steel sheets reels or coils are used as part of a system making easier to implement passive conditioning mechanisms such as cooling, ventilation, heating and/or sound isolation.

The new system decreases the construction time, volume of debris, the building weight and the carbon footprint against the traditional systems. The walls and plates airtightness is obtained from the sealing of the junctions between "tube and tube" and between "tube and main structure". Structure allows inducing inner airflows and additionally the piping may be used as container of materials with thermal and/or sound properties which modify the climatic and/or sound conditions inside the building.

System has been created and structured in such a way that it allows decreasing the construction times, volume of debris, the building weight and the carbon footprint complying with the earthquake-resistance codes of construction. Process starts with the use of a steel sheet reel or coil of 130 to 140 millimeters wide which is transformed through a machine into steel tubes with a diameter of 190 to 215 millimeters. After having made the tube an oval machine is used to achieve a cross-section of 50 to 70 millimeters wide and a height of 280 to 300 millimeters.

In parallel the main structure of steel columns and beams is built by connecting C-shaped beams which serve as a guide to install tubes in walls and plates. In the case of the first floor, a C-shaped beam must be connected to the floor plate, additionally steel sheet stiffeners of 2 centimeters to 7 centimeters wide and having the same thickness of the walls and plates tubes must be placed every 2 to 4 meters. The stiffeners shall be installed across the tubes or in a diagonal bracing system.

To comply with the ventilation function, a column is connected with the tube located in the lower part of the adjacent wall to generate a single airtight duct which shall be a fireplace. In the lower end of the fireplace a passive extractor whether solar or wind shall be installed and in the inner end of the fireplace a ventilation grill shall be installed. The location of the grill on the outer part of the wall allow ventilating the inner part of the piping for conditioning while its installation in the outer part allows suctioning the building inner air.

Piping of walls and plates contain other materials with particular thermal and/or sound properties modifying the conditions inside of the building for thermal and sound isolation. Such materials from sand, stone, gravel, rock, plastic polyurethane, polyethylene, and polymers, polystyrene must be hermetically confined and for that reason the ends of the container tube must be sealed with a sealing material.

In cases when heating is needed, it is necessary that materials contained in the tube are oriented to thermal mass generation creating greenhouse effect. The heat accumulation of these elements may be strengthened by applying the greenhouse effect taking the surface of the pipe exposed to sun radiation and coating it with a dark paint and in a distance of 1 to 4 centimeters a transparent elements allowing the entry of sun radiation and which impede the exit of thermal radiation is hermetically installed forcing that heat release is only outside the building. This same principle may be used to inject hot air inside of the building, in which case the connector's tubes of thermal mass are vertically installed and the container material must allow air pass. In the upper part of the tube inside of the building a grill is installed to inject hot air, while in the lower part a grill for cold air to the structure accumulating heat is installed. If the grill is installed inside of the building, a closed circuit which recirculates inner air is generated, while if grills is outside an open system with hot air ventilation is created.

This configuration may be implemented for one or several tubes, in which tubes must be connected with each other, in such a way that system is a coil increasing the distance travelled by the air inside of the thermal mass to gain higher temperature in the air.

The thermal conductivity of the steel sheet constituting the tube decreases due to less thermal conductivity areas in the tube by making slots along the piping and on the "tube-tube" contact surface and/or by using thermal isolation coating.

TECHNICAL DESCRIPTION AND FIGURES

The main characteristics of the structural bioclimatic and sound system shall be described below, supported on the graphs attached and following the same sequence.

FIG. 1 shows the beam-column main structure (1), as the beginning of an earthquake-resistant structure.

FIG. 2 shows the steel piping of 190 to 215 millimeters made from a steel sheet reel or coil of 130 to 140 millimeters wide and a thickness of 0.3 to 0.7 millimeters, to be transformed into an oval piping by a machine specially designed for such purpose which makes oval piping with a height of 280 to 300 millimeters and 50 to 70 millimeters wide in the center.

Figure 1:
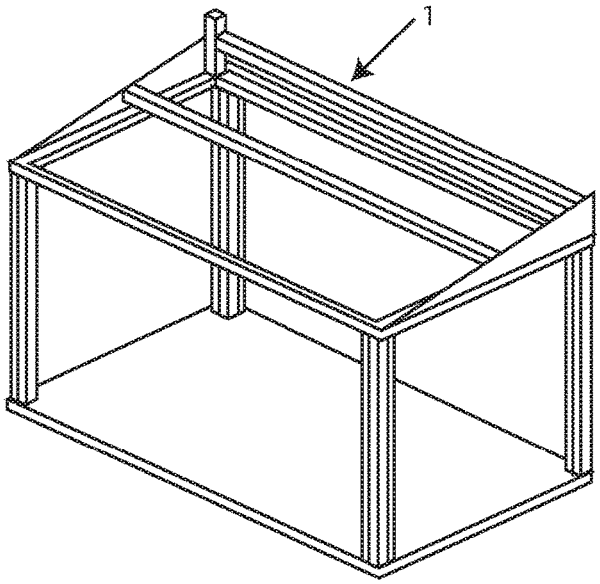
FIG. 1 shows the main structure installation
Figure 2:
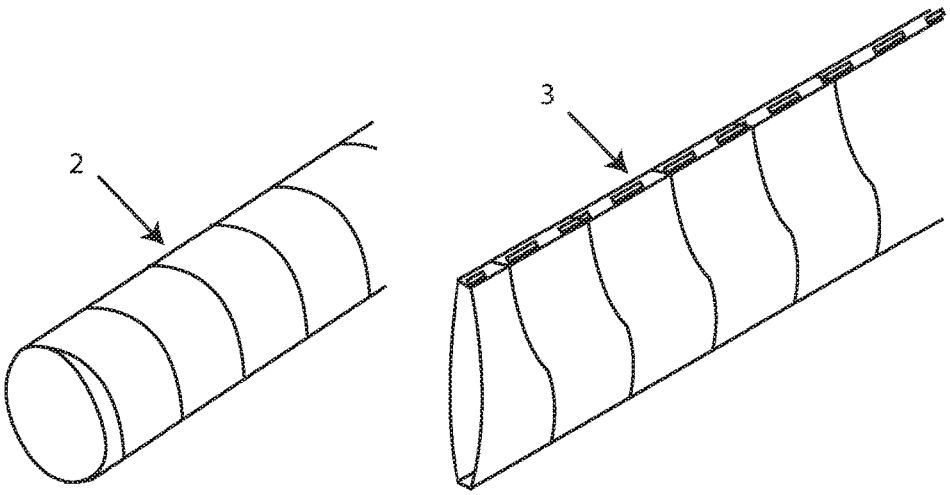
FIG. 2 shows the conformation of round and oval piping
Figure 3:
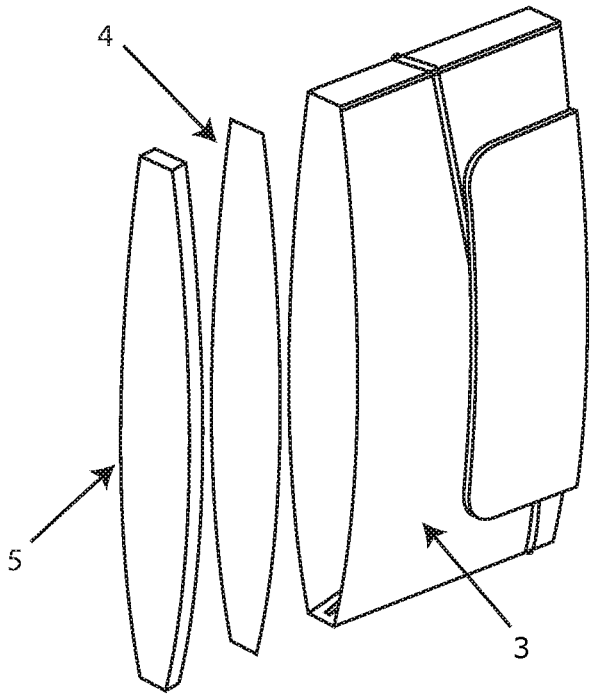
FIG. 3 shows the tube airtightness with filling material and sealing material.

It is important to say that airtightness in all the system junctions must be ensured since this is an important part to enhance the thermal and sound comfort of the building. In FIG. 3 to ensure the airtightness in the steel oval tube (3) filling material must be applied (4) in the ends to then apply sealing material (5).

Figure 4:
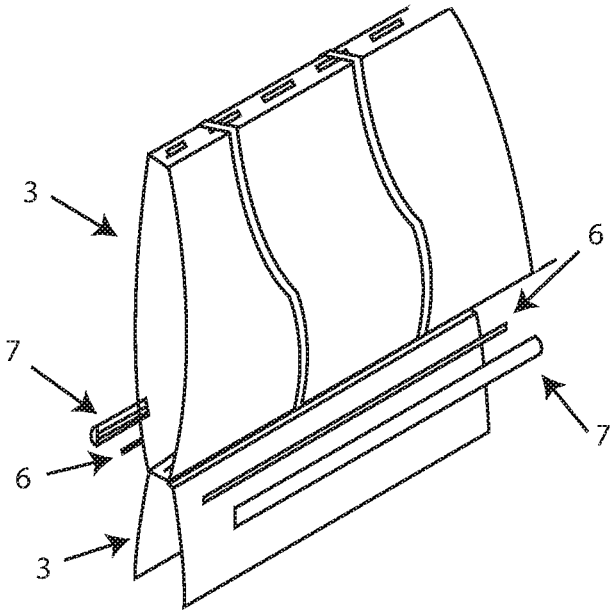
FIG. 4 shows the airtight sealing between tube and tube with their junctions.

FIG. 4 shows the airtight seal between the steel oval tube (3) and other steel oval tube (3), internally sealed with filling material along the base junction (6) which then is sealed in the side junction (7)

Figure 5:
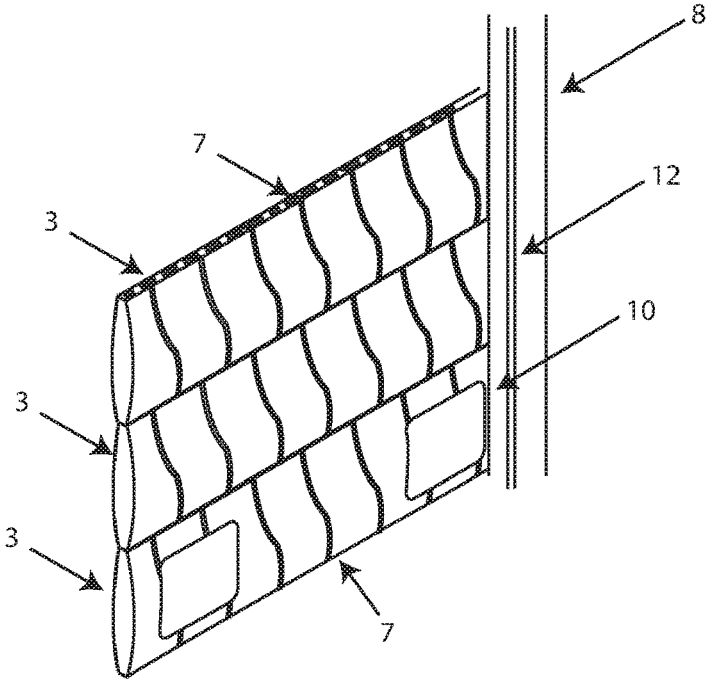
FIG. 5 shows the coupling of piping for walls and plates connected to columns.

FIG. 5 shows how to install the structural bioclimatic and sound system; after installing the beam-column main structure (1) the steel oval tubes (3) slide through the C-shaped beam (10) which is previously connected with the structural steel column (8), to be part of the beam-column main structure (1) of steel columns and beams, previous an airtight sealing between the C-shaped beam (10) and the structural steel column (8) through sealing along the junction (12), also, it is important to ensure that between the junction of steel oval tube (3) and the steel oval tube (3) there is airtightness through the sealing material along the junction (7)

Figure 6:
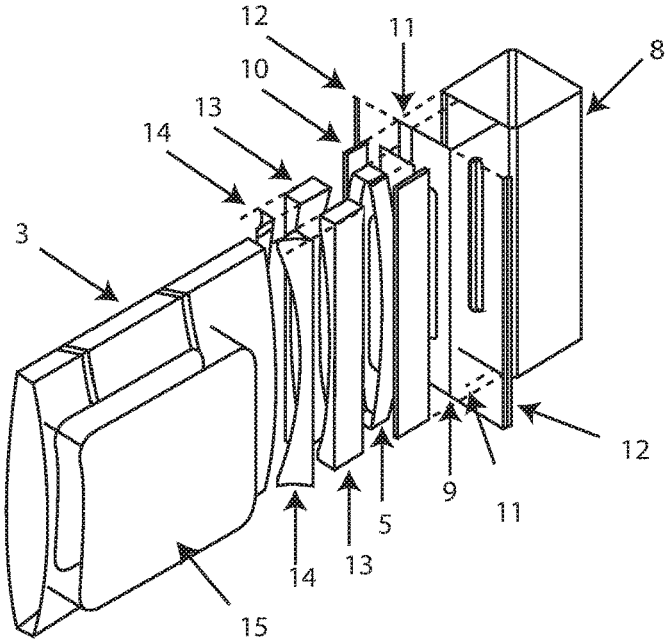
FIG. 6 shows the airtight conformation between tube and channel and between channel and column

FIG. 6 shows the conformation of the cross-section airtight junction between the tube and channel and between the channel and structural beam (8) of the structural bioclimatic and sound system, making special emphasis in the junction made between the steel oval tube (3) and the C-shaped beam (10), by using the filling material (13) and then by applying sealant along the junction (14), on the other hand, it shows that the steel structural column (8) and the C-shaped beam (10) have a slot on the upper part, so that the steel structural column (8) preserves its structural properties a reinforcement platen (9) is installed just before the C-shaped beam (10). This junction must be secured with filling material along the junction (11) and by applying sealing material (12) to give airtightness to the junction. If work is to be made inside the steel oval tube (3) the steel oval tube (3) may be cut near to the C-shaped beam (10) and then covered with a cover (15).

Figure 7:
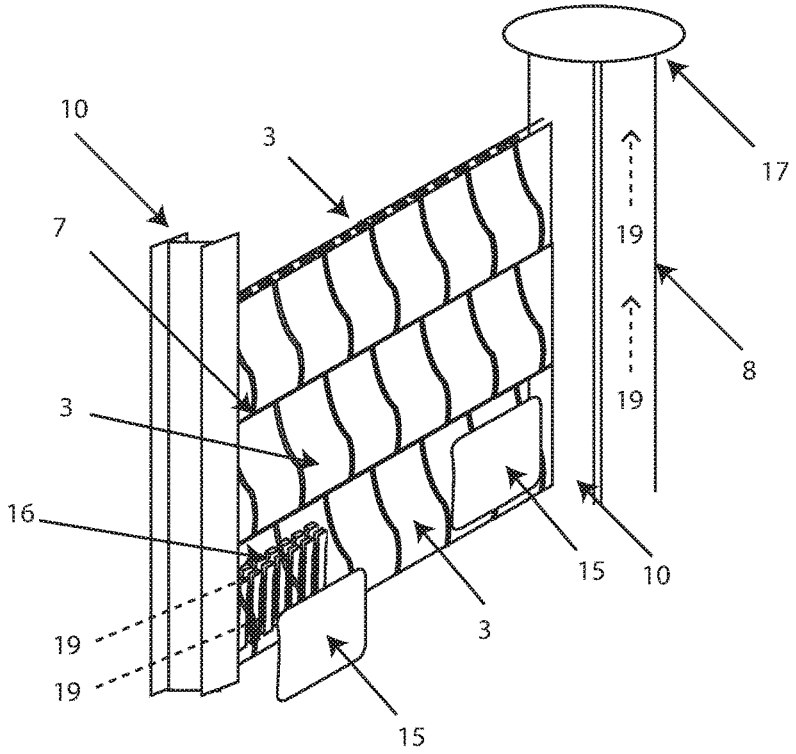
FIG. 7 shows the airflow in tubes when using thermo siphon
Figure 8:
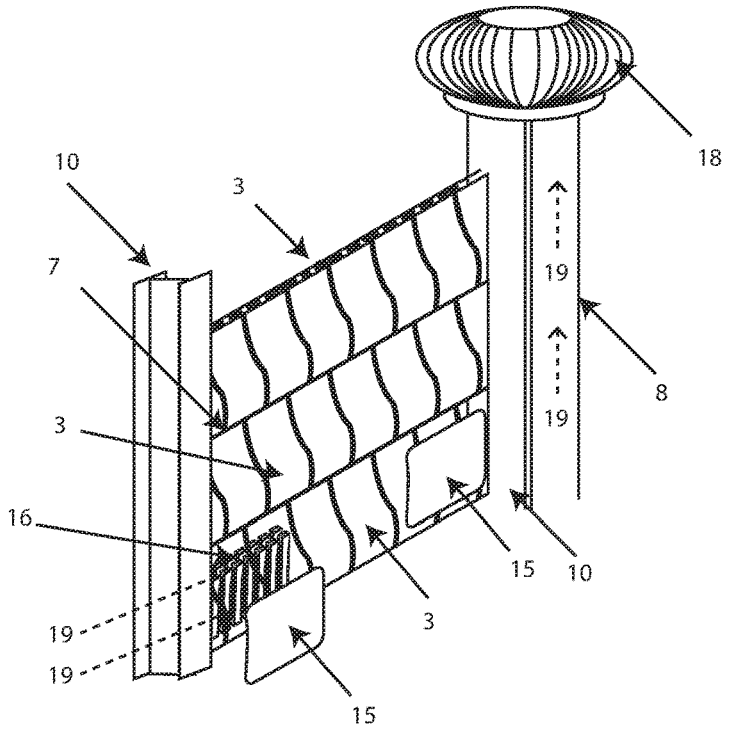
FIG. 8 shows the airflow in tubes when using passive ventilator

FIG. 7 and FIG. 8 show the air circulation (19) inside of the steel oval tube (3) and the steel structural column (8) when entering air through the entry grill (16), it is important to say that the C-shaped beam (10) has no slot near to the entry grill (16), the difference between FIG. 7 and FIG. 8 is that it shows the use of the system as a thermo siphon (17) or as a passive air extractor (18)

Figure 9:
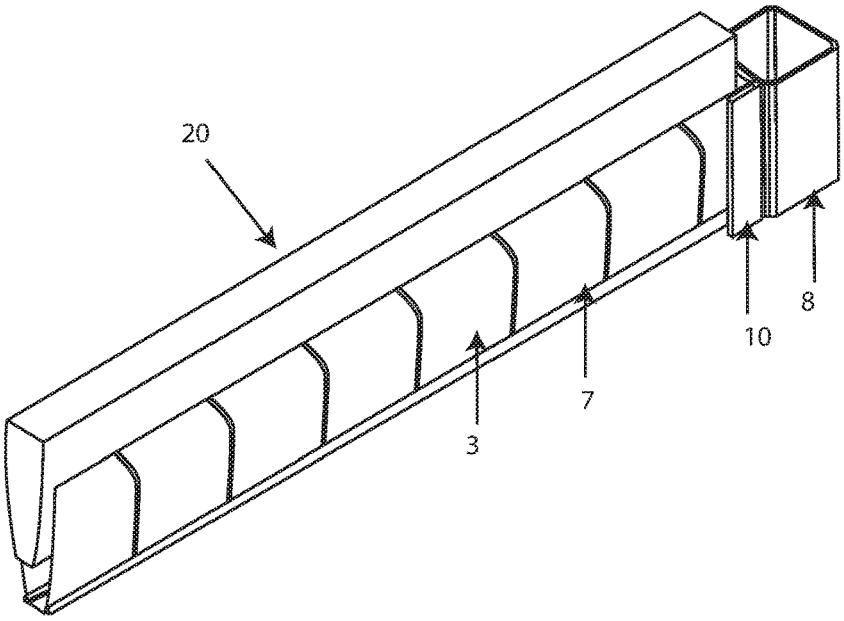
FIG. 9 shows the system as a container for materials with thermal or sound properties.

FIG. 9 shows the system as a container for materials with thermal and/or sound properties (20), which serve to ensure the building comfort, this thermo-sound properties material (20) must be along the steel oval tube (3) and airtightness must be secured inside of it with sealing material (5).

Figure 10:
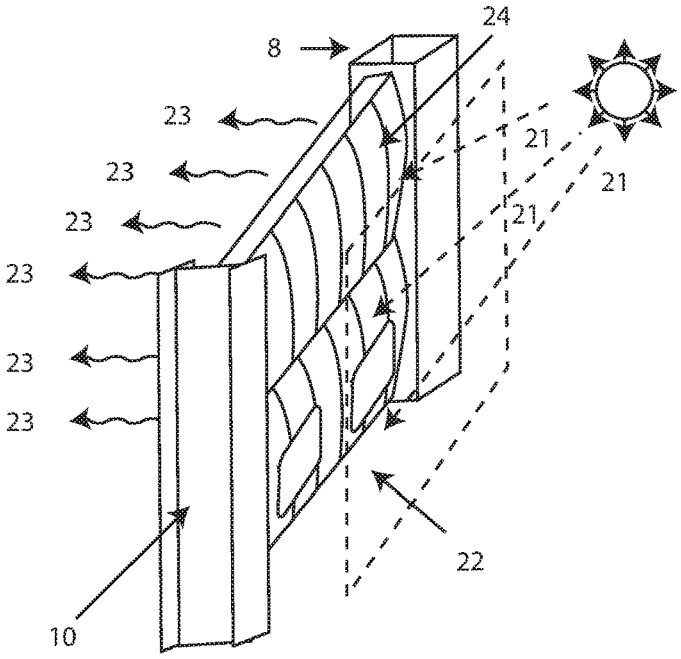
FIG. 10 shows the system configuration to create the greenhouse effect
Figure 11:
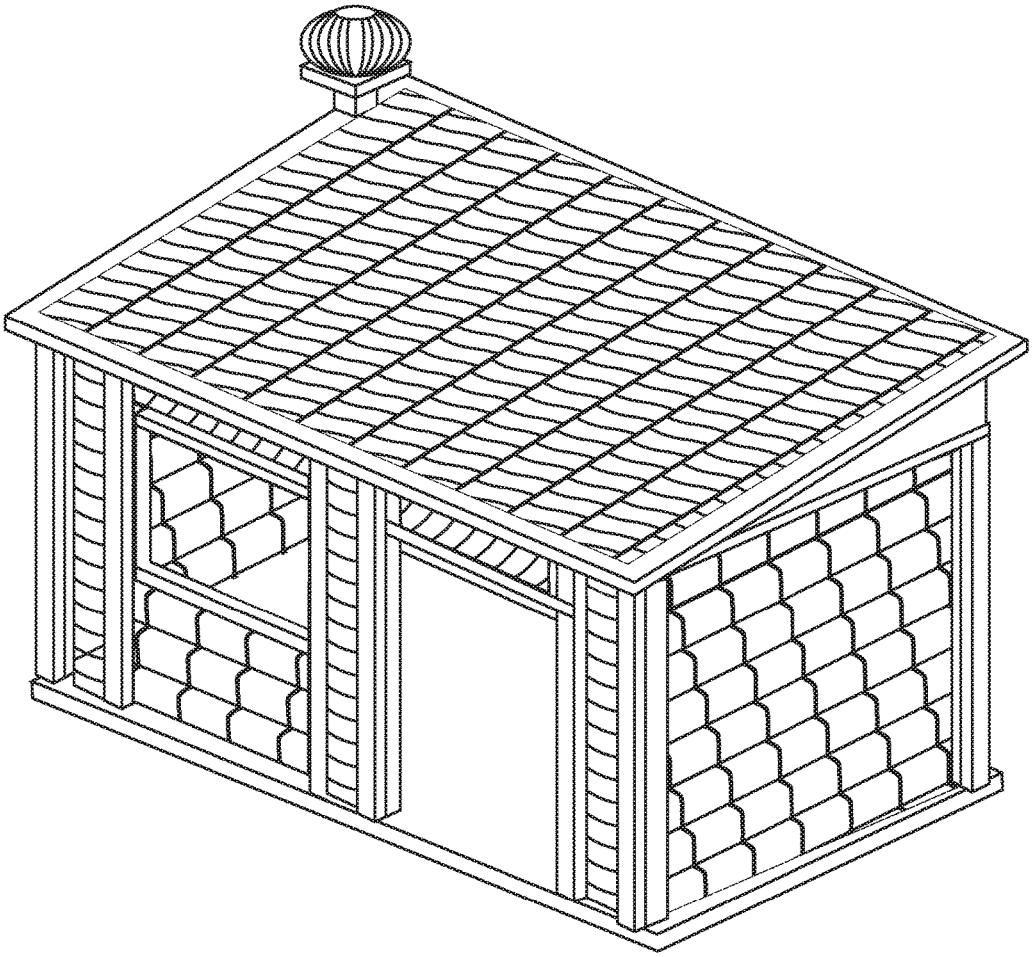
FIG. 11 shows the configuration of external plate and wall in a building.

FIG. 10 shows how the configuration of the system would enhance the greenhouse effect to improve the climatic conditions inside of the building, for this a transparent plate (22) is installed to allow the entrance of sun radiation (19) but it does not allow the exit of thermal radiation (23), forcing the thermal radiation (23) to exit only inside of the building. It is important to explain that the steel oval tubes (3) must be filled with materials with thermal and/or sound properties (20) and they must be painted with dark paint (24) on the part facing the sun, where the filling materials with thermo-sound properties (20) for thermal isolation are taken from cork, cotton, wood chips, ardite, vermiculite, wheat husks, spelt, linen, cereal lump, hemp, cellulose, wood fiber, wood wool, canes, straw, herb, rock wool, glass wool, natural sheep wool, cellulose foam, PSM; the filling materials with thermo-sound properties (20) for the thermal mass are taken from oil, plaster, silicon, acrylic, epoxy, polyurea, polyethylene, polymers and polystyrene.

The invention claimed is:

1. A structural system of steel walls and plates with bioclimatic and sound application characterized by having an external plate of transparent material (22); a steel oval piping (3) externally exposed to sun radiation and having a length of 280 to 300 millimeters, a width of 50 to 70 millimeters and a thickness of 0.3 to 0.7 millimeters, within which air flows via either a thermo siphon (17) or a passive air extractor (18), said steel oval piping (3) being airtight sealed to another steel oval piping (3) along a length of a base junction (6) between both steel oval piping (3), wherein sealing material is provided at a lateral junction (7) airtight sealing said base junction (6), a lateral end of said steel oval piping (3) is joined to an inner channel of a C-shaped beam (10) at a junction (11) and said C-shaped beam (10) is also joined to a structural column (8) of a beam-column main structure (1), wherein each lateral end of said steel oval piping (3) is sealed with a filling material (4) that is covered with a sealing material (5) and a thermo-acoustic isolating material (20) is provided inside and along the length of said steel oval piping (3).

2. The structural system of steel walls and plates with bioclimatic and sound application according to claim 1, wherein the C-shaped beam (10) is connected to a floor plate and steel sheet stiffeners are provided every 2 to 4 meters along the length of said floor plate, said steel sheet stiffeners having a width of 2 to 7 centimeters.

3. The structural system of steel walls and plates with bioclimatic and sound application according to claim 1, wherein a surface of the steel oval piping (3) exposed to sun radiation is coated with a dark paint (24) and the external plate of transparent material (22) is positioned at a distance of 1 to 4 centimeters away from said surface of the steel oval piping (3).

4. The structural system of steel walls and plates with bioclimatic and sound application according to claim 1, wherein said C-shaped beam (10) is hermetically joined to said structural column (8) with a sealing material (12).

5. The structural system of steel walls and plates with bioclimatic and sound application according to claim 1, wherein a filling material (13) is provided between the lateral end of said steel oval piping (3) and the inner channel of said C-shaped beam (10), a sealing material being provided over a junction (14) between said lateral end of said steel oval piping (3) and said inner channel of said C-shaped beam (10), wherein a reinforcement plate (9) is provided between said C-shaped beam (10) and said structural column (8).

6. The structural system of steel walls and plates with bioclimatic and sound application according to claim 1, wherein the steel oval piping (3) has a cover (15).

7. The structural system of steel walls and plates with bioclimatic and sound application according to claim 1, wherein an entry grill (16) is provided at an upper part of an internal surface of said steel oval piping (3) for injecting hot air and another entry grill (16) is provided at a lower part of the internal surface of said steel oval piping (3) for entering cold air into a heat storing structure.

8. The structural system of steel walls and plates with bioclimatic and sound application according to claim 1, wherein an entry grill (16) is provided at an internal surface of said steel oval piping (3) for injecting hot air and another entry grill (16) is provided at an external surface of said steel oval piping (3) for venting hot air outside the beam-column main structure (1).

9. The structural system of steel walls and plates with bioclimatic and sound application according to claim 1, wherein the thermo-acoustic isolating material (20) is selected from at least one of: cork cotton, wood chips, arlite, vermiculite, wheat husks, spelt, linen, cereal lump, hemp, cellulose, wood fiber, wood wool, canes, straw, herb, rock wool, glass wool, natural sheep wool, cellulose foam, polyurethane foam, elastomeric foam, PSM, oil, plaster, concrete, clay, break, stone, gravel, and rock.

10. The structural system of steel walls and plates with bioclimatic and sound application according to claim 9, wherein said thermo-acoustic isolating material (20) is hermetically confined within said steel oval piping (3) by the sealing material (5) which is selected from at least one of: plastic, silicon, acrylic, epoxy, polyurea, polyurethane, polyethylene, polymers and polystyrene.

* * * * *